US009557128B2

(12) United States Patent
Miller, III

(10) Patent No.: US 9,557,128 B2
(45) Date of Patent: Jan. 31, 2017

(54) REVERSIBLE SAFETY SELECTOR FOR AR15-TYPE FIREARM

(71) Applicant: Spike's Tactical, LLC, Apopka, FL (US)

(72) Inventor: Thomas James Miller, III, Lehigh Acres, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 14/861,065

(22) Filed: Sep. 22, 2015

(65) Prior Publication Data

US 2016/0091268 A1 Mar. 31, 2016

Related U.S. Application Data

(60) Provisional application No. 62/055,219, filed on Sep. 25, 2014.

(51) Int. Cl.
*F41A 17/00* (2006.01)
*F41A 17/46* (2006.01)

(52) U.S. Cl.
CPC ..... *F41A 17/46* (2013.01)

(58) Field of Classification Search
CPC ..... F41A 17/46
USPC ..... 42/70.01, 70.06, 70.07; 89/148
See application file for complete search history.

(56) References Cited

U.S. PATENT DOCUMENTS

| | | | | |
|---|---|---|---|---|
| 5,251,533 | A | 10/1993 | Layton | |
| 5,760,328 | A * | 6/1998 | Robbins | F41A 19/46 89/129.02 |
| 7,654,187 | B2 | 2/2010 | Hochstrate et al. | |
| 8,047,119 | B2 | 11/2011 | Hochstrate et al. | |
| 8,276,502 | B1 | 10/2012 | Wright | |
| 8,756,847 | B2 | 6/2014 | Huther | |
| 8,806,790 | B1 * | 8/2014 | Huang | F41A 17/74 42/70.08 |

(Continued)

*Primary Examiner* — Gabriel Klein
(74) *Attorney, Agent, or Firm* — Wood Herron & Evans LLP

(57) ABSTRACT

Disclosed is a reversible safety selector switch for an AR15-type firearm including a control shaft and a control lever. The control shaft is pivotably mountable about an axis in a lower receiver and has a cam portion with first and second cam surfaces and a detent portion having a surface and first and second detent grooves with detent sockets at each end of each groove. The first detent groove extends circumferentially approximately 90 degrees along the surface and the second detent groove extending circumferentially less than 90 degrees along the surface. A control lever is connectable to an end of the control shaft and configured for manipulation outside the receiver by a user to axially rotate the control shaft. When the selector is installed in the receiver, a detent pin in the receiver engages one of the detent grooves and prevents axial rotation beyond a detent socket, the first cam surface and first detent groove are positioned to allow axial rotation of the shaft between "safe" and "fire" positions in approximately 90 degrees of rotation and the second detent groove being positioned to allow axial rotation of the shaft between "safe" and "fire" positions in less than 90 degrees of rotation when installed with the detent pin engaging the second detent groove.

5 Claims, 9 Drawing Sheets

(56) References Cited

U.S. PATENT DOCUMENTS

| | | | | |
|---|---|---|---|---|
| 2005/0241470 | A1* | 11/2005 | Hochstrate | F41A 19/46 89/142 |
| 2007/0180984 | A1* | 8/2007 | Huther | F41A 17/74 89/148 |
| 2011/0167696 | A1* | 7/2011 | Gangl | F41A 17/46 42/69.03 |
| 2012/0279384 | A1 | 11/2012 | Hochstrate et al. | |
| 2012/0325044 | A1 | 12/2012 | Brown | |

* cited by examiner

REVERSIBLE SAFETY SELECTOR FOR AR15-TYPE FIREARM

RELATED APPLICATION

This application claims priority to and the benefit of U.S. Provisional Patent Application No. 62/055,219, filed Sep. 25, 2014, the contents of which is incorporated herein by reference.

TECHNICAL FIELD

This invention relates to a safety selector for an AR15-type firearm. More specifically, it provides a safety selector that is reversible to provide either 90 degree or 45 degree movement between "safe" and "fire" positions.

BACKGROUND

The safety selector in a common AR15-type semi-automatic firearm operates by rotation of a lever 90 degrees from a "safe" position to the "fire" position. In the "safe" position, an internal shaft of the selector blocks movement of a rearwardly extending portion of the trigger member. When rotated to the "fire" position, a flat or recessed portion of the shaft is positioned over the rearwardly extending portion of the trigger member, allowing actuating movement of the trigger. A spring biased detent pin engages detent notches with a connecting groove therebetween to limit rotation of the safety selector to 90 degrees and to provide certain positioning in the "fire" and "safe" positions. Although the standard AR15 safety selector has an actuation lever only on the left side of the firearm receiver, ambidextrous safety selectors have been provided, which attach a second actuation lever on an opposite end of the selector shaft to provide actuation from the right side of the receiver as well.

Adaptations have been made to safety selectors for AR15-type firearms, as well as other similarly operating firearms, so that there is only 45 degrees of rotation between the "safe" and "fire" positions. Although certain military requirements have specified a 45 degree selector, it has not been widely adopted in the field.

In order to convert the safety selector from one that operates with 90 degrees of rotation to one that operates with 45 degrees of operation, replacement of the safety selector part is required. Although the conversion can be accomplished by a person of minimal skill using minimal tools, a separate part has to be interchanged with the existing part to accomplish the conversion.

SUMMARY OF THE INVENTION

The present invention provides a reversible safety selector switch for a firearm. The selector switch has a control shaft pivotably mountable in a lower receiver for selective rotation about an axis. The shaft has a cam portion with first and second cam surfaces and a detent portion with a surface. The detent portion has first and second detent grooves with detent sockets at each end of each groove. The first detent groove extends circumferentially approximately 90 degrees along the surface and the second detent groove extends approximately less than 90 degrees along the surface. A control lever is configured for manipulation outside the receiver by a user to axially rotate the control shaft. When the selector is installed in the receiver, a detent pin in the receiver engages a selected one of the detent grooves and prevents axial rotation beyond a detent socket. The first cam surface and first detent groove are positioned to allow axial rotation of the shaft between "safe" and "fire" positions in approximately 90 degrees of rotation when installed with the detent pin engaging the first detent groove. The second cam surface and the second detent groove are positioned to allow axial rotation of the shaft between "safe" and "fire" positions in less than 90 degrees of rotation when installed with the detent pin engaging the second detent groove. According to one embodiment, the second detent groove allows axial rotation of approximately 45 degrees.

"Reversal" or conversion of the selector can be accomplished in different ways. According to one embodiment, the shaft can be turned end for end to change between 90 degree and 45 degree installations. According to another embodiment, the shaft can be rotationally oriented relative to the control lever to change between 90 degree and 45 degree installations.

No modification to the AR15-type receiver is required and the selector may be operated from either a single side of the receiver or ambidextrously (control levers on both sides). No additional parts are required to be added or substituted to accomplish the reversal or conversion of the selector to change between 90 degree and 45 degree installations.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING

Like reference numerals are used to indicate like parts throughout the various figures of the drawing, wherein.

DETAILED DESCRIPTION

Figure 1:
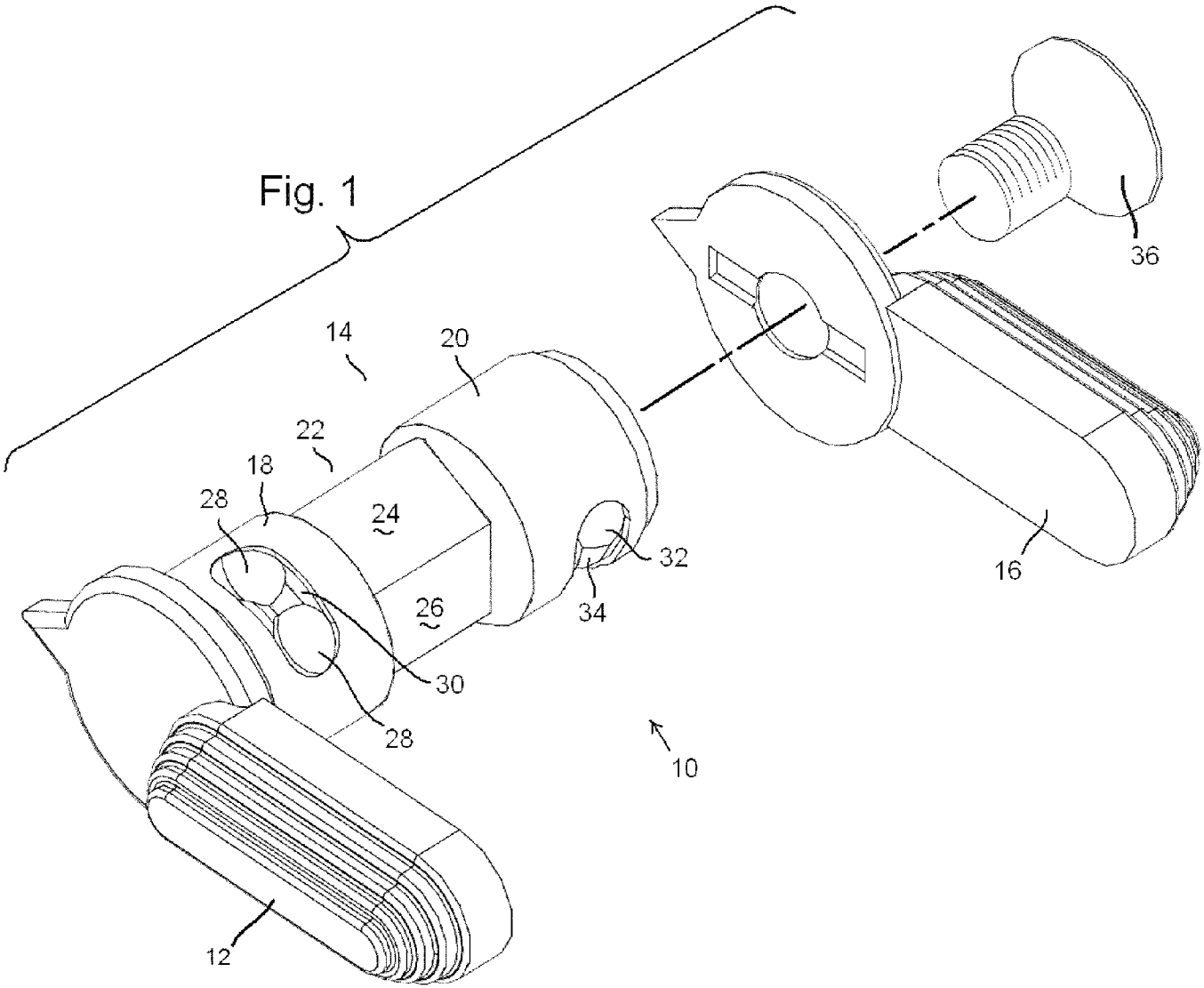
FIG. 1 is an exploded pictorial view of a reversible safety selector according to one embodiment of the present invention.
Figure 3:
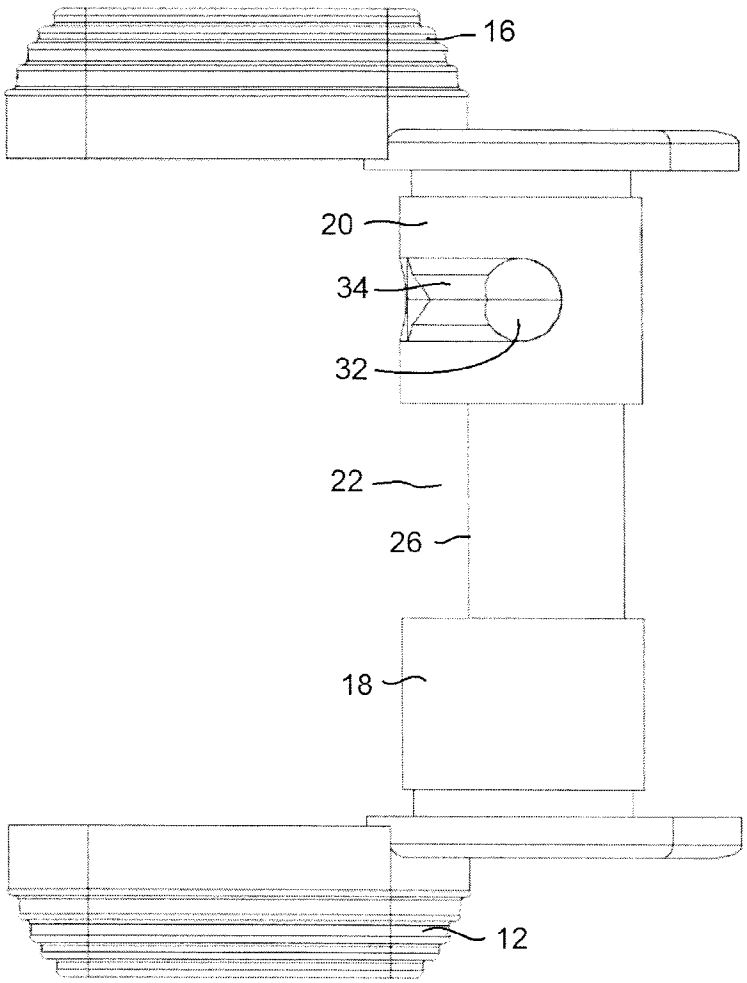
FIG. 3 is a top plan view thereof.
Figure 2:
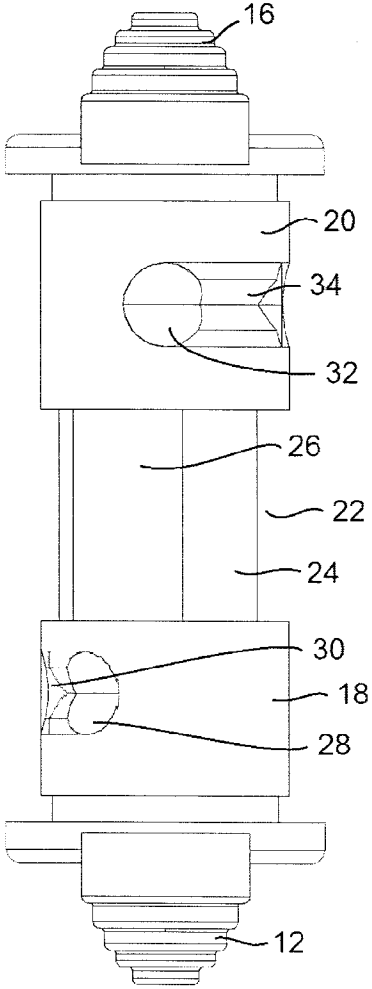
FIG. 2 is an assembled rear plan view thereof.
Figure 5:
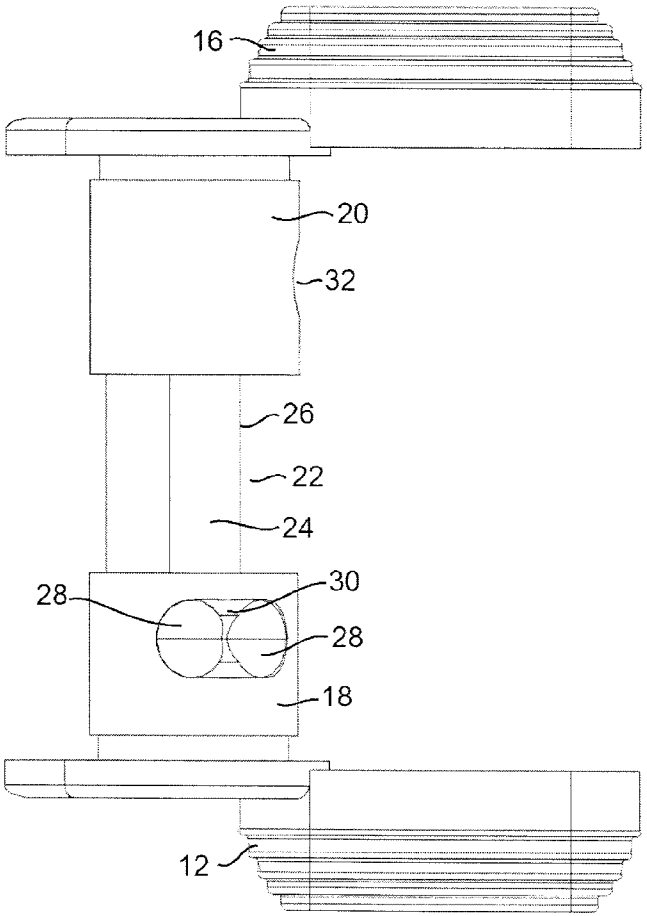
FIG. 5 is a bottom plan view thereof.
Figure 4:
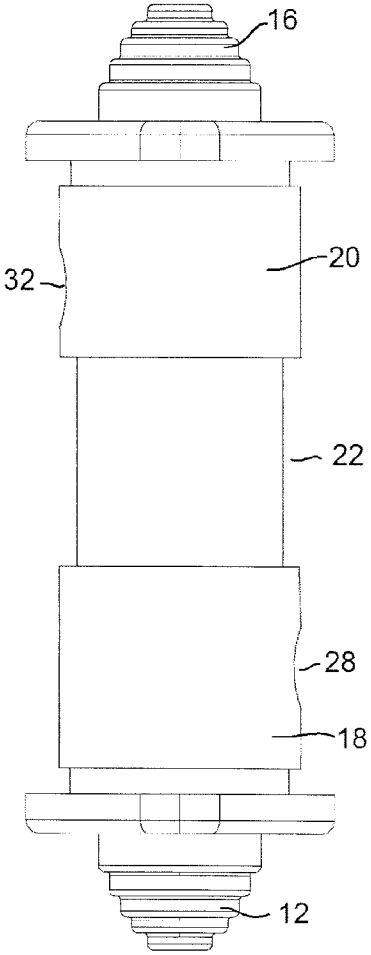
FIG. 4 is a front plan view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

The present invention provides a safety selector for AR15-type firearms that is reversible between a first configuration in which it provides an approximately 90 degree rotational switch between "safe" and "fire" positions, and a second orientation in which the same device will provide an approximately 45 degree selection between "safe" and "fire" positions. Other operational ranges, such as 30 degrees and 60 degrees, may be selected as well. However, 90 degree and 45 degree safety selector switches are the most common. As used herein, "AR15-type" is meant to include variants of the AR15- and AR10-platform firearms, whether in a rifle or pistol configuration and without respect to what other accessories or features may be included on or in the firearm.

Figure 20:
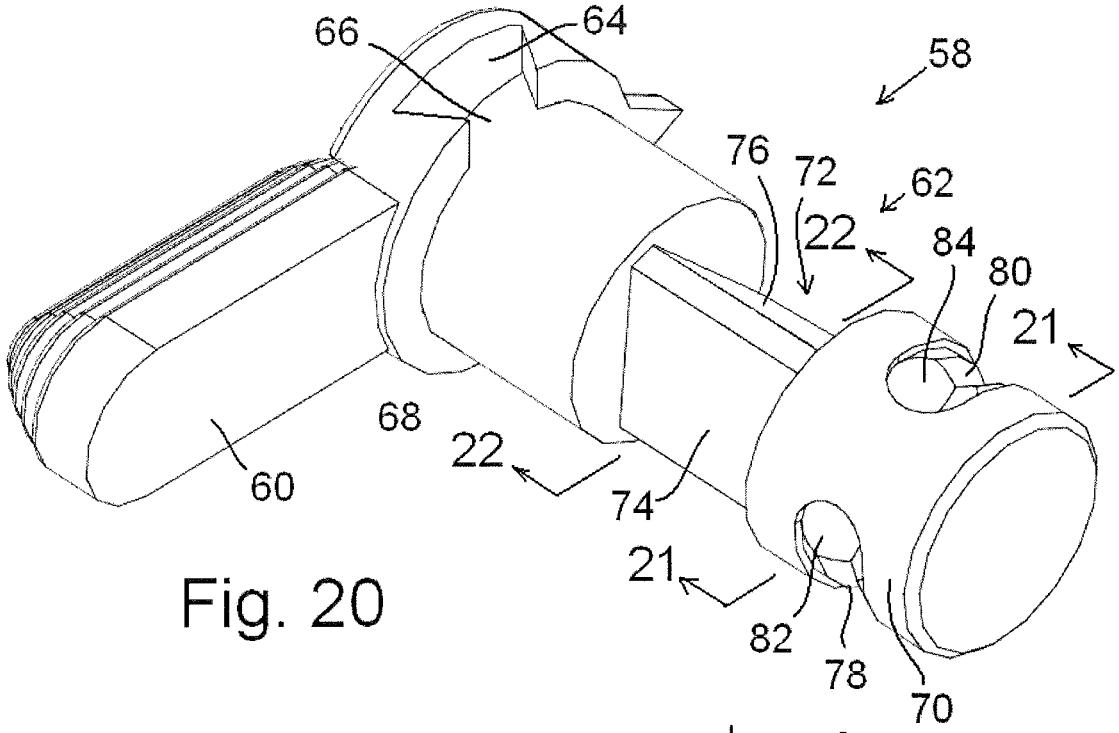
FIG. 20 is an isometric view of a reversible safety selector according to another embodiment of the present invention.

Referring first to FIGS. 1-5, therein is shown at 10 a selector according to one embodiment of the present invention. The selector includes a first operating lever 12, a pivotable shaft 14, and a second operation lever 16. One or both of the levers 12, 16 may be disassembled from the shaft 14 for installation. The shaft 14 includes a first hub portion 18 at one end thereof and a second hub portion 20 at the opposite end thereof. Between the hub portions 18, 20 is a cam portion 22 having one or more recessed faces 24, 26, the operation of which will be described later. The first hub portion 18 includes detent sockets 28 with a circumferential groove 30 extending therebetween. The second hub portion 20 also includes detent sockets 32 with a circumferential groove 34 extending therebetween. The location of the detent sockets 28, 32 and circumferential grooves 30, 34 relative to the recessed faces 24, 26 are important to the operation of the present invention and will be described in further detail below. Either or both of the operating levers 12, 16 may attach to the shaft 14, such as by a threaded fastener 36 of well-known configuration. As shown, one of the operating levers 12 may be formed integrally with the shaft 14 and the other lever 16 detachable therefrom. The attachment between the operating lever 16 and shaft 14 includes some type of interlocking configuration such as a tongue and groove (as shown in FIG. 1) or a dove tail attachment (as shown in FIG. 20). Either of these attachment means is well known, but the exact nature and interlocking means is not important to the present invention. Additionally, the reversible safety selector 10 of the present invention could be made operational with only a signal operating lever, that lever being either integral or removably attachable to either end of the shaft 14.

Figure 6:
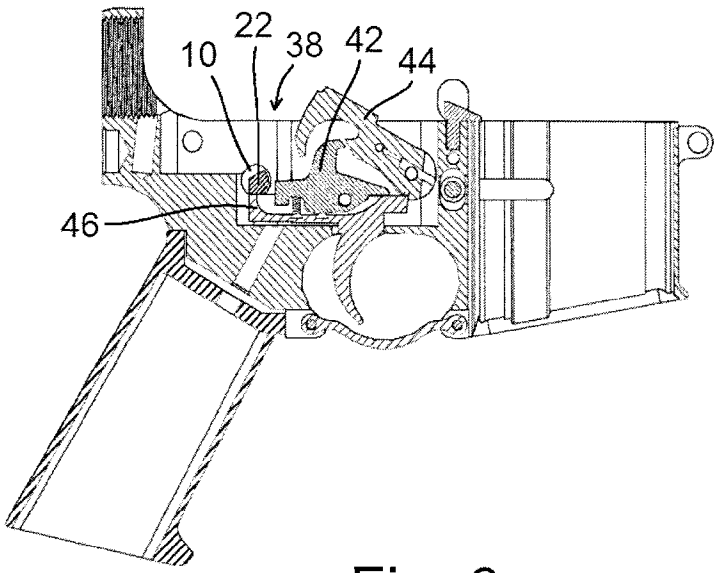
FIG. 6 is a side sectional view of an AR15-type firearm receiver and pistol grip with a fire control mechanism installed therein, including a reversible safety selector according to one embodiment of the present invention.

FIG. 6 shows the orientation and location of the reversible safety selector 10 in the lower receiver 38 of a common AR15-type firearm. The receiver 38 carries a fire control mechanism comprising a trigger 40, a disconnector 42, a hammer 44, and associated springs (not shown), the operation of which is typical and well-known in the art. The trigger 40 includes a rearwardly-extending portion 46 which may be engaged by the cam portion 22 of the safety selector shaft 14. As shown in FIG. 6, the selector 10 is in the "safe" position preventing pivotal movement of the trigger 40.

Figure 7:
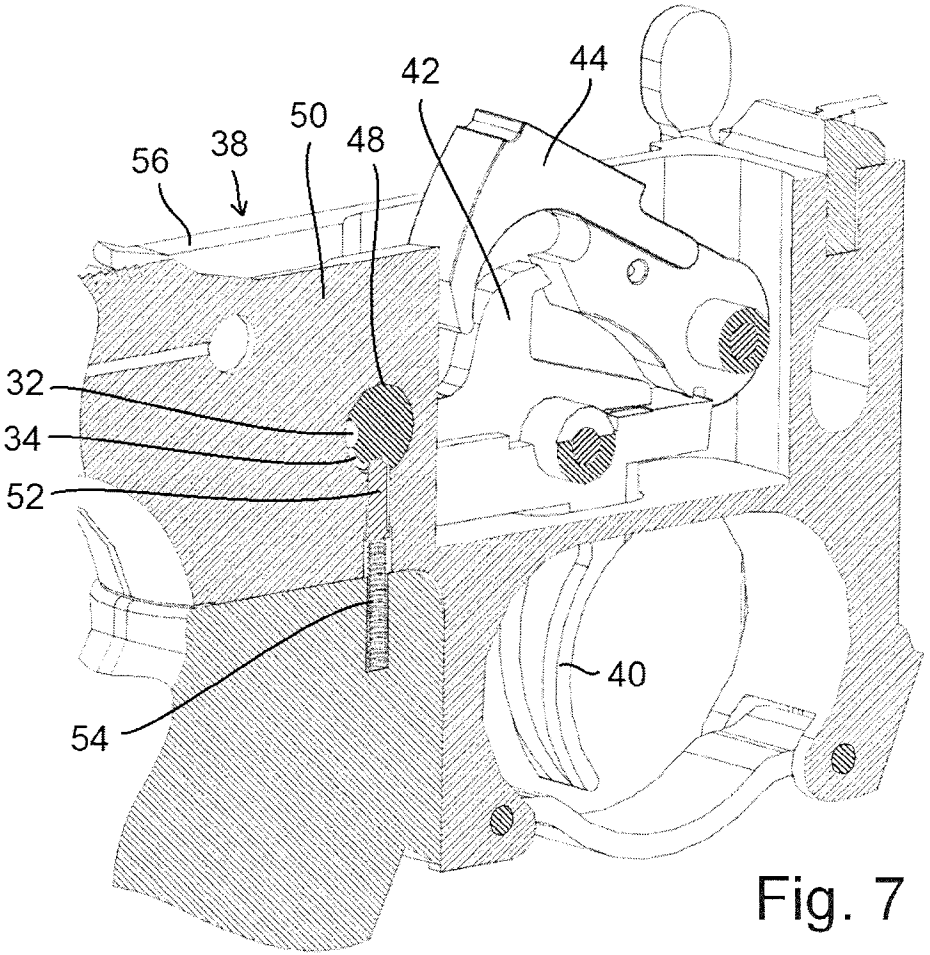
FIG. 7 is a fragmentary, partially cut-away isometric view of an AR15-type firearm receiver and pistol grip with a fire control mechanism installed therein, including a reversible safety selector according to one embodiment of the present invention.

Referring now to FIG. 7, therein is shown that the hub portions 18, 20 of the shaft 14 are carried in openings 48 in opposite walls of the lower receiver 38. Within the right side wall 50 of the receiver 38, there is a detent pin 52 that is biased upwardly by a spring 54. The detent pin 52 is positioned to engage the detent sockets 28, 32 and circumferential grooves 30, 34 in the hubs 18, 20 of the selector shaft 14. Operation of the detent pin 52 with a safety selector in an AR15-type firearm is common and well known in the art. As shown in FIG. 7, the detent pin 52 will engage the detent sockets 32 at 90 degrees of rotation between "safe" and "fire" positions.

As can be seen by study of FIGS. 1-5 and knowledge of how a safety selector switch operates in a typical AR15-type firearm, as shown in FIGS. 6 and 7, it can be seen that when the selector 10 is installed in the receiver 38 in a first configuration, the selector 10 is changed from the "safe" position to the "fire" position by rotating the selector shaft 14 approximately 90 degrees. The selector 10 is installed such that the first hub portion 18 is carried by the left side wall 56 of the receiver and the second hub portion 20 is carried by the right side wall 50 of the receiver 38. In an embodiment where one operating lever 12 is integral with the shaft 14, the shaft 14 may be inserted from the left side of the receiver 38. In an embodiment where the first operating lever 12 is detachable from the shaft 14, the shaft 14 may be inserted into the aligned openings 48 from either side of the receiver 38.

If the installation of the shaft 14 is reversed in the receiver 38, such that the first hub portion 18 is carried by the right side wall 50 and the second hub portion 20 is carried by the left side wall 56 of the receiver, the safety selector 10 will now operate between "safe" and "fire" positions by rotation of only approximately 45 degrees. As described above, if the first operating lever 12 is formed integrally with the shaft 14, the shaft 14 may be installed from the right side of the receiver. In this installation, the detent pin 52 engages the detent sockets 28 and circumferential groove 30 in the first hub portion 18 of the shaft 14. The recessed faces 24, 26 of the cam portion 22 are oriented such that in either installation the rearwardly extending portion 46 of the trigger 40 is blocked when the selector 10 is in the "safe" position and is not blocked when the selector 10 is in the "fire" position, after rotation of the selector 10 by either 90 degrees or 45 degrees, depending on which way the shaft 14 is installed in the receiver 38.

Figure 8:
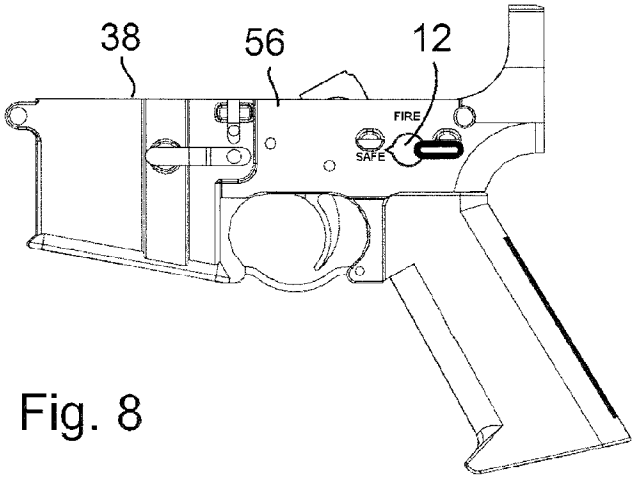
FIGS. 8 and 9 are left side plan views of the receiver with a safety selector according to an embodiment of the invention in "safe" and "fire" positions situated 90 degrees apart.
Figure 9:
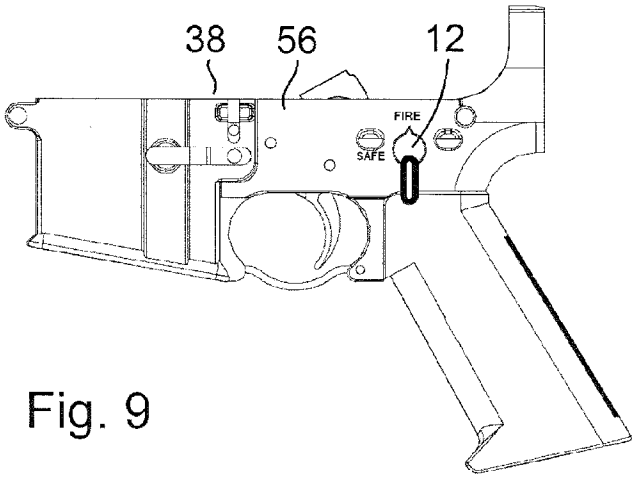
Figure 10:
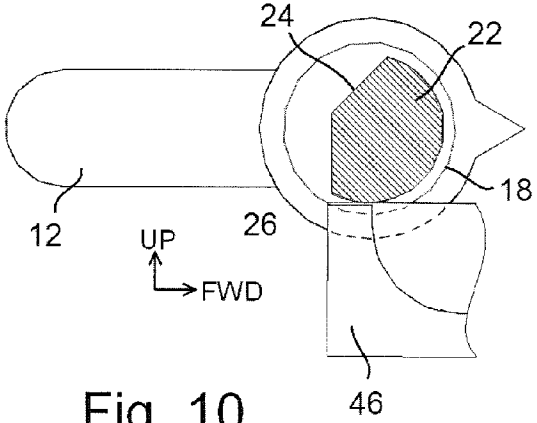
FIGS. 10 and 11 are fragmentary cross-sectional views thereof showing the safety selector in "safe" and "fire" positions.
Figure 11:
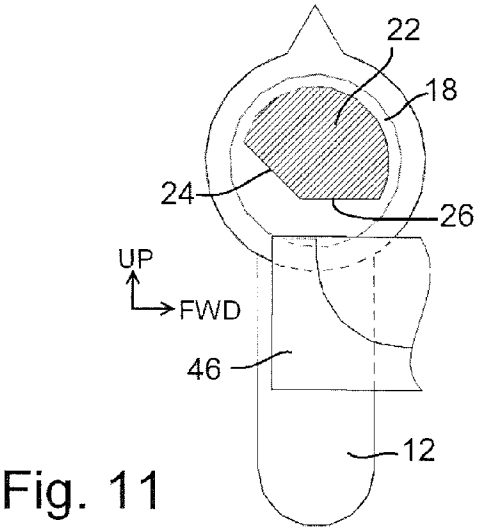
Figure 12:
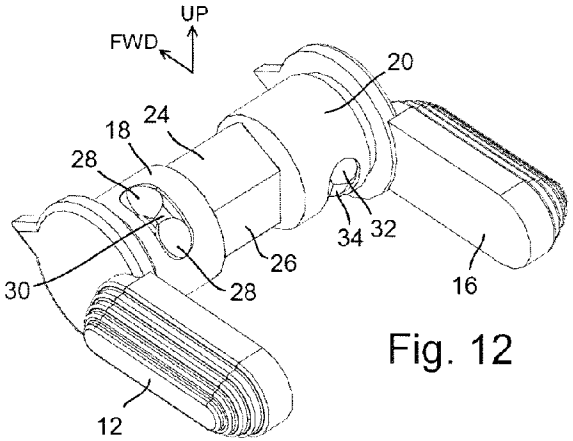
FIGS. 12 and 13 are isometric views thereof.
Figure 13:
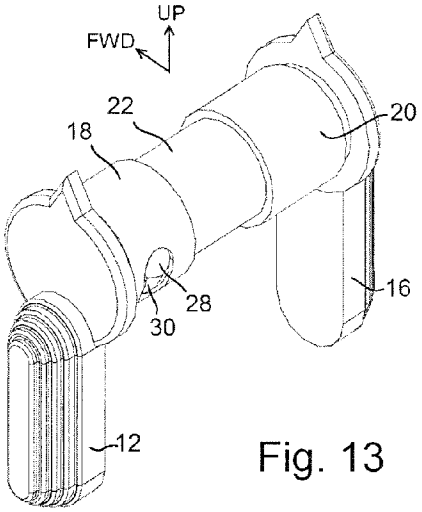

FIGS. 8-13 show in detail how the reversible selector 10 may be installed for operation through 90 degrees of rotation. FIGS. 8, 10, and 12, show the selector 10 in the "safe"

position. In the "safe" position, the cam portion 22 of the shaft 14 engages the rearwardly extending portion 46 of the trigger to prevent its upward movement if the trigger 40 is pulled. When the operating lever 12 and shaft 14 are rotated 90 degrees, as shown in FIGS. 9, 11, and 13, a first recessed face 26 is oriented toward the rearwardly extending portion 46 of the trigger 40, allowing it to move upwardly a distant sufficient for operation of the trigger 40. In this configuration, the detent pin 52 engages the detent sockets 32, which are situated circumferentially on the hub 20 at 90 degrees apart. The circumferential groove 34 between the detent sockets 32 allows the selector 10 to be rotated through this 90 degrees of travel, but not beyond the detent sockets 32 in either direction.

Figure 14:
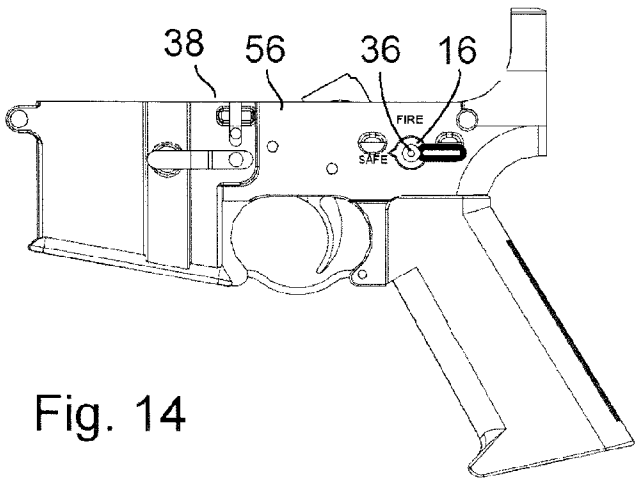
FIGS. 14 and 15 are views similar to FIGS. 8 and 9, showing the present invention in a reversed position in which actuation of the safety selector between "safe" and "fire" positions is accomplished in 45 degrees of travel.
Figure 15:
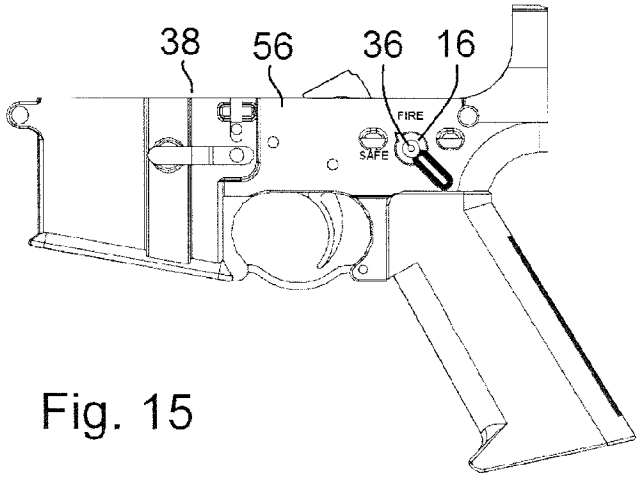
Figure 16:
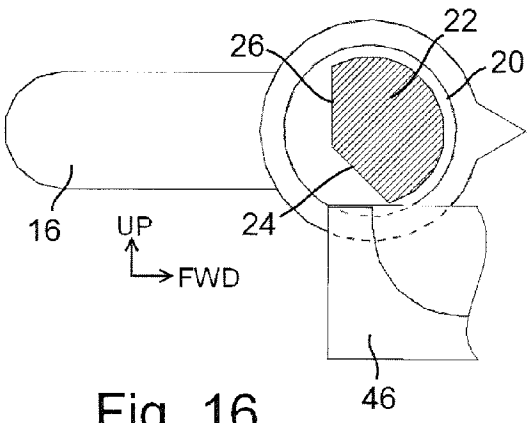
FIGS. 16 and 17 are fragmentary cross-sectional views thereof.
Figure 17:
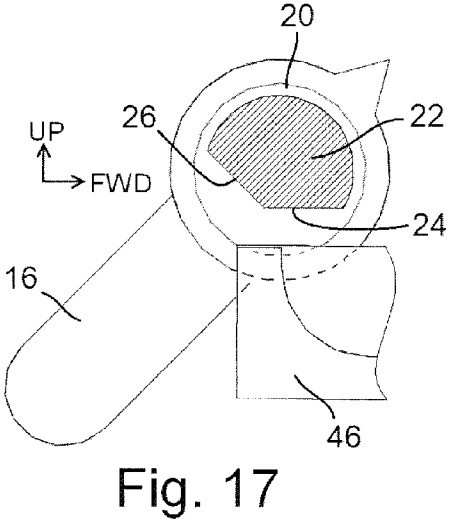
Figure 18:
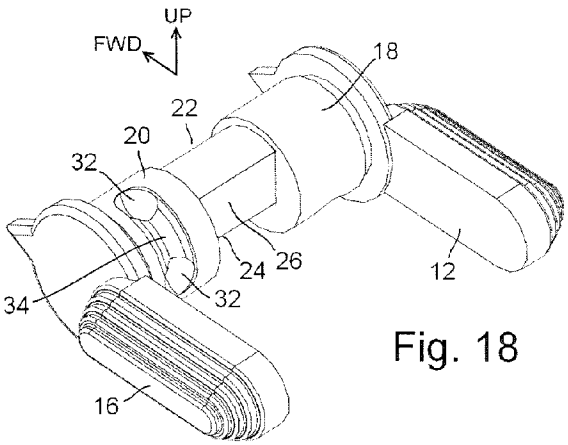
FIGS. 18 and 19 are isometric views thereof.
Figure 19:
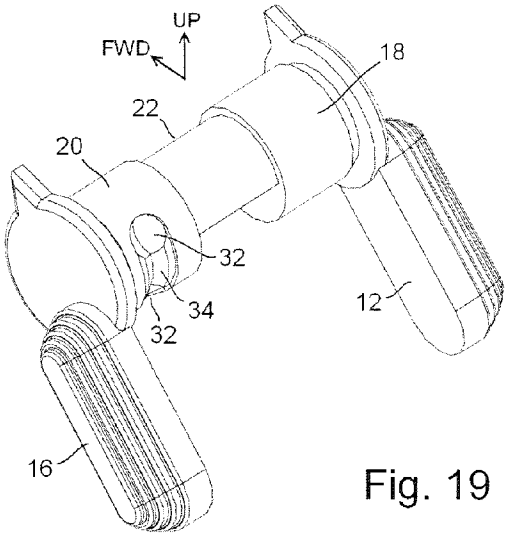

As shown in FIGS. 14-19, installation of the selector 10 may be reversed so that shifting between the "safe" and "fire" positions is accomplished with only 45 degrees of rotation. FIGS. 14, 16, and 18 show the selector 10 in the "safe" position. As seen in FIG. 16, the cam portion 22 of the shaft 14 blocks upward movement of the rearwardly extending portion 46 of the trigger 40. As shown in FIGS. 15, 17, and 19, the safety selector 10 may be shifted to the "fire" position by rotating it only 45 degrees. As shown in FIG. 17, when rotated to the "fire" position, the second recessed face 24 is oriented toward the rearwardly extending portion 46 of the trigger 40, allowing sufficient upward movement for actuation of the trigger 40.

Referring now to FIGS. 20-25, therein is shown at 58 a reversible safety selector according to another embodiment of the present invention. In this embodiment, the selector 58 includes at least one operating lever 60 that is detachably secured to a rotatable shaft 62. The operating lever 60 may be removable secured to the shaft 62 by any means that prevents relative rotation between the two members 60, 62. As shown in FIG. 20, the operating lever 60 may include a transverse dovetail groove 64 that mates with a transverse dovetail tenon 66 at one end of the shaft 62. As described above, a mortise and tenon connection like that shown in FIG. 1 could also be used.

The shaft 62 includes two hub portions 68, 70 with a cam portion 72 therebetween. The cam portion 72 includes first and second cam surfaces 74, 76. In this embodiment, one hub portion 70 includes first and second detent grooves 78, 80 with detent sockets 82, 84 at the end of each groove 78, 80. The operation and function of the second embodiment relative to the receiver 38 and fire control mechanism of the firearm is exactly the same as that of the first embodiment—only the manner of changing from one installation to the other is different.

Figure 21:
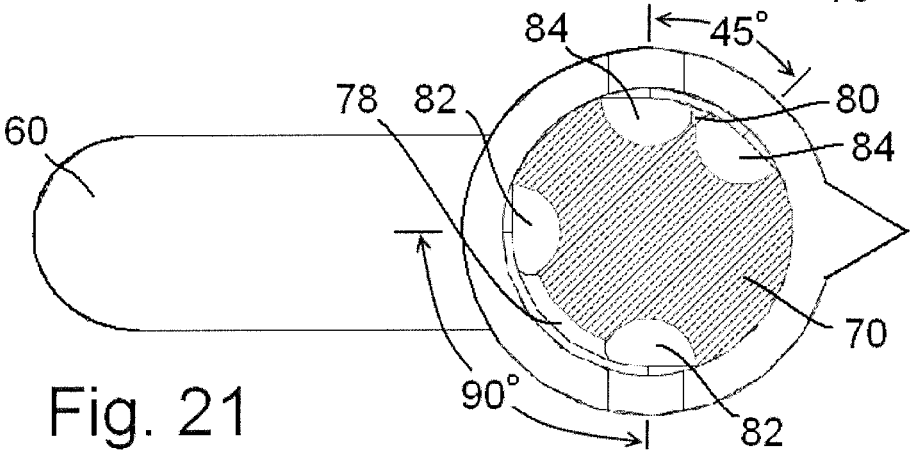
FIG. 21 is a cross-sectional view take substantially along line 21-21 of FIG. 20.

As shown in FIG. 21, the detent grooves 78, 80 are situated on the hub 70 such that one detent socket 82, 84 of each detent groove 78, 80 is oriented diametrically opposite the other. In this manner, referring also to FIG. 22, the selector 58 may be installed so that it may be manipulated between "safe" and "fire" positions to orient the first cam surface 74 by rotation of approximately 90 degrees.

Figure 22:
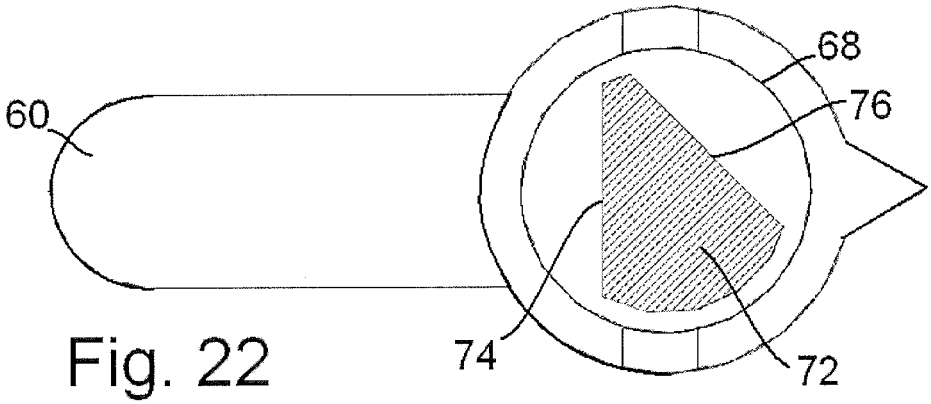
FIG. 22 is a cross-sectional view take substantially along line 22-22 of FIG. 20.
Figure 23:
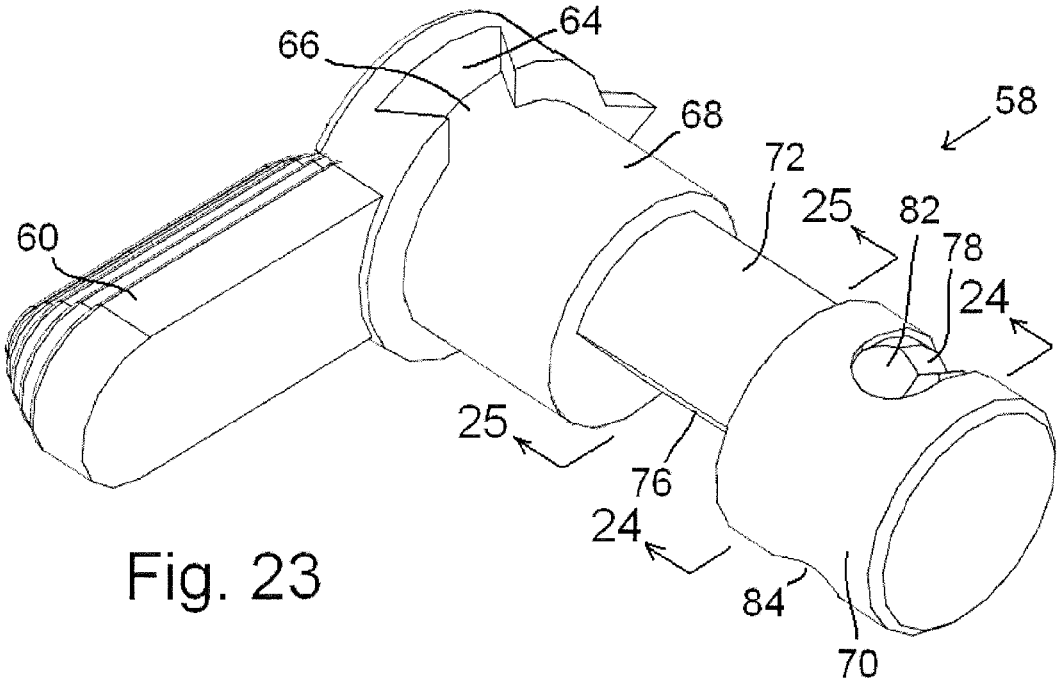
FIG. 23 is an isometric view showing the selector in a reversed installation for 45 degree operation.
Figure 24:
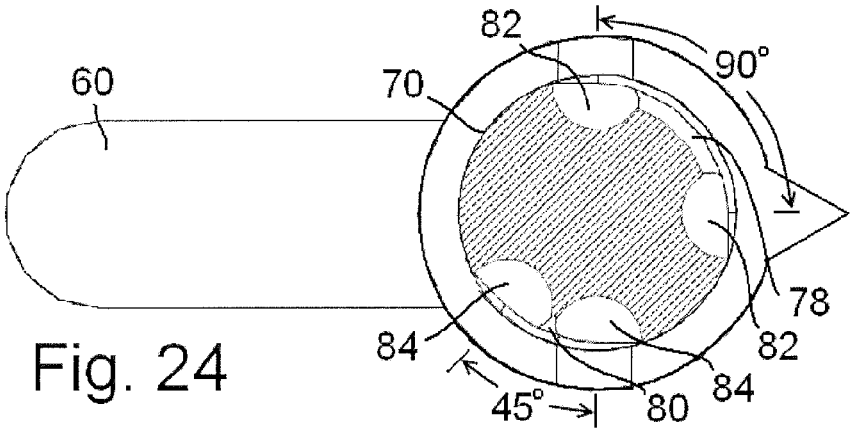
FIG. 24 is a cross-sectional view take substantially along line 24-24 of FIG. 23.
Figure 25:
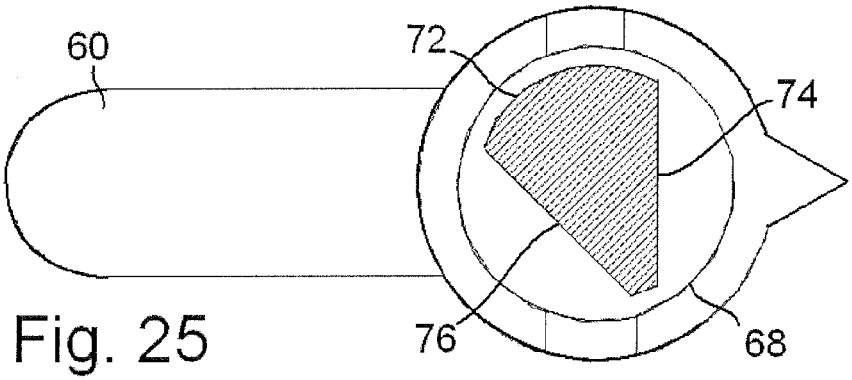
FIG. 25 is a cross-sectional view take substantially along line 25-25 of FIG. 23.

Referring now to FIGS. 23-25, it can be seen that conversion between 45 degree and 90 degree operation can be accomplished simply by installation of the operating lever 60 with the shaft 62 rotated 180 degrees the installation depicted in FIGS. 20-22. In this manner, conversion from 45 degree operation to 90 degree operation is accomplished by changing the rotational position of the shaft 62 rather than an end for end reversal of the shaft 14 shown in the first embodiment. If desired, this embodiment may include a second operating lever (not shown) attachable to the opposite end of each shaft 62 to make the selector switch 58 ambidextrous.

As evident from the description above, the present invention provides a safety selector 10, 58 for an ordinary AR15-type firearm that may be reversibly installed to provide either 90 degree or 45 degree operation. No additional parts are required to be kept or substituted in order to convert the selector 10, 58 from one configuration to the other. As such, a person with minimal skill and minimal tools may convert the safety selector 10, 58 from one configuration to the other, and back again, easily and as often desired.

While two embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A reversible safety selector switch for a firearm, comprising:

a control shaft pivotably mountable about an axis in a lower receiver, the shaft having a cam portion, the cam portion having first and second recessed faces and a remainder of the cam portion being a substantially uninterrupted trigger movement blocking cam surface, and a hub portion having at least one substantially cylindrical surface and first and second detent grooves with detent sockets at each end of each groove, the first detent groove extending circumferentially approximately 90 degrees along at least one substantially cylindrical surface of the hub portion and the second detent groove extending circumferentially less than 90 degrees along at least one substantially cylindrical surface of the hub portion; and a control lever connectable to an end of the control shaft and configured for manipulation outside the receiver by a user to axially rotate the control shaft, wherein, when the selector is installed in the receiver, a detent pin in the receiver engages a selected one of the detent grooves and prevents axial rotation beyond a detent socket, the first cam portion face and first detent groove being positioned to allow axial rotation of the shaft only between safe and fire positions in approximately 90 degrees of rotation when installed with the detent pin engaging the first detent groove and the second cam portion face and second detent groove being positioned to allow axial rotation of the shaft only between safe and fire positions in less than 90 degrees of rotation when installed with the detent pin engaging the second detent groove.

2. The safety selector switch of claim 1, wherein the less than 90 degrees of axial rotation allowed by the second detent groove is approximately 45 degrees of axial rotation.

3. The safety selector switch of claim 1, wherein the hub portion comprises first and second hub portions, the second hub portion axially spaced from the first hub portion with the cam portion situated axially therebetween, each of the first and second hub portions having a substantially cylindrical surface, wherein the first detent groove, corresponding to the first recessed face, is on the first hub portion and the second detent groove, corresponding to the second recessed face, is on the second hub portion.

4. The safety selector of claim 1, wherein the control lever is attachable to the control shaft at either of two diametrically opposed positions on one end of the control shaft, the first position being associated with installation of the selector switch with the detent pin engaging the first detent groove to allow axial rotation of the shaft only between safe and fire positions in approximately 90 degrees of rotation and the second position being associated with installation of the selector switch with the detent pin engaging the second detent groove to allow axial rotation of the shaft only between safe and fire positions in less than 90 degrees of rotation.

5. The safety selector switch of claim 1, further comprising a second control lever connectable to an opposite end of the control shaft and configured for ambidextrous manipulation of the control shaft.

* * * * *